US005467175A

United States Patent [19]

Takagaki et al.

[11] Patent Number: 5,467,175

[45] Date of Patent: Nov. 14, 1995

[54] DEVELOPING DEVICE FOR AN IMAGE FORMING APPARATUS

[75] Inventors: Hiromitsu Takagaki, Yokohama; Nobuo Iwata, Sagamihara; Koji Suzuki, Yokohama, all of Japan

[73] Assignee: Ricoh Company, Ltd., Tokyo, Japan

[21] Appl. No.: 172,818

[22] Filed: Dec. 27, 1993

[30] Foreign Application Priority Data

Dec. 30, 1992 [JP] Japan ..... 4-361016

[51] Int. Cl.[6] ..... G03G 15/08

[52] U.S. Cl. ..... 355/259; 118/653; 355/245; 355/253

[58] Field of Search ..... 355/246, 259, 355/251, 253, 260, 245; 118/653, 661, 657, 658

[56] References Cited

U.S. PATENT DOCUMENTS

| | | | |
|---|---|---|---|
| 4,774,541 | 9/1988 | Martin et al. | 118/653 |
| 4,987,452 | 1/1991 | Nakagawa et al. | 355/245 |
| 5,012,285 | 4/1991 | Oka et al. | 355/245 |
| 5,132,734 | 7/1992 | Momiyama et al. | 355/253 |
| 5,132,735 | 7/1992 | Howland | 355/261 |
| 5,166,472 | 11/1992 | Maeda et al. | 118/653 |
| 5,170,213 | 12/1992 | Yamaguchi et al. | 355/246 |
| 5,182,601 | 1/1993 | Hodoshima et al. | 355/270 |
| 5,223,893 | 6/1993 | Ikemoto et al. | 355/200 |
| 5,232,500 | 8/1993 | Kamaji et al. | 118/261 |
| 5,268,718 | 12/1993 | Maeda et al. | 355/245 |
| 5,286,918 | 2/1994 | Iwata et al. | 118/653 |
| 5,289,237 | 2/1994 | Hashizume et al. | 355/245 |
| 5,339,140 | 8/1994 | Zeman et al. | 355/246 |

*Primary Examiner*—A. T. Grimley
*Assistant Examiner*—T. A. Dang
*Attorney, Agent, or Firm*—Oblon, Spivak, McClelland, Maier & Neustadt

[57] ABSTRACT

In a developing device for developing a latent image formed on an image carrier with a developer, a developer carrier conveys the developer deposited thereon to the image carrier. A developer driving section moves, in a position adjoining the developer carrier and where the developer is at least apt to aggregate, the developer such that the developer is loosened. A developer charging member deposits a predetermined amount of charge on the developer. The developer charging member is located downstream of the developer driving section with respect to the direction of rotation of the developer carrier and upstream of a developing position where the developer carrier faces the image carrier. The device is small size and inexpensive since it does not include a conventional sponge roller or similar developer supply member. In addition, the device prevents the developer from aggregating in the vicinity of the developer carrier and stabilizes the deposition of a charge on the developer carried on the developer carrier.

8 Claims, 11 Drawing Sheets

DEVELOPING DEVICE FOR AN IMAGE FORMING APPARATUS

BACKGROUND OF THE INVENTION

The present invention relates to a developing device for a copier, facsimile apparatus, printer or similar image forming apparatus and, more particularly, to a developing apparatus of the type having developer storing means storing a predetermined amount of developer, and a developer carrier to which the developer is supplied from the storing means. The developer carrier conveys the developer deposited thereon to an image carrier to develop a latent image formed on the image carrier.

An image forming apparatus of the type described is advantageously implemented with a developing device using a one component type developer, i.e., toner from the size, cost and reliability standpoint. Particularly, to effect color development, it is desirable to use a non-magnetic toner since this kind of toner is highly transparent. In a conventional developing device using a toner, a developer supply member is pressed against a developer carrier to supply the toner from developer storing means to the developer carrier. The developer carrier conveys the toner deposited thereon to an image carrier along a predetermined circulation path including a developing region. This type of device is taught in, for example, Japanese Patent Laid-Open Publication (Kokai) Nos. 60-229057 and 61-42672.

The prerequisite with the above-described type of developing device is that the image carrier and the developer carrier be rotated at substantially the same peripheral speed during the course of development. Otherwise, the toner would concentrate more in the trailing edge portion of an image than in the other portion. In the light of this, there has been proposed a developing device elaborated to deposit a required amount of toner and a required amount of charge on the developer carrier and the toner, respectively. For example, a developing device disclosed in Japanese Patent Laid-Open Publication No. 2-15110 has a developing roller, or developer carrier, whose surface is made up of a conductive portion connected to ground and dielectric portions distributed in the conductive portion in a regular or irregular pattern. The dielectric portions each has a small area. A sponge roller, or developer supply member, is rotatable in contact with the surface of the developing roller. A toner is frictionally charged by the two rollers contacting each other. At the same time, the dielectric portions of the developing roller are frictionally charged by the sponge roller and toner to form a great number of small closed electric fields, or microfields, in the vicinity of the surface of the developing roller. As a result, the frictionally charged toner is deposited on the developing roller in multiple layers by the microfields.

There has also been proposed a developing device having a toner container located at a higher level than a developing roller and partly or entirely implemented as a flexible member. Means for causing the flexible member to dent into the toner container is located to face the flexible member. With this arrangement, the device causes a toner aggregated on the bottom of the toner container to move positively. As a result, toner supply to the developing roller is prevented from failing due to the aggregation of the toner. This kind of scheme is taught in Japanese Patent Laid-Open Publication No. 4-152369 by way of example.

However, the developing devices disclosed in Japanese Patent Laid-Open Publication Nos. 60-229057, 61-42672 and 2-15110 have some problems left unsolved, as follows. To begin with, the sponge roller or similar developer supply member increases the cost of the device and needs an extra space for installation. Moreover, the toner supply member is driven in contact with the developing roller or similar developer carrier and, therefore, requires an extra driving force. Moreover, the force necessary for the developer carrier to be driven is increased due to the friction between the developer carrier and the developer supply member. Should the sponge roller be omitted to reduce the size and cost of the device, the toner would be aggregated below the developer carrier, resulting in short toner supply to the developer carrier. This is also true with the developing device proposed in Japanese Patent Laid-Open Publication No. 4-152369. In addition, the conventional devices frictionally charge the toner on the developer carrier, relying mainly on the developer supply member. Hence, when the developer supply member is omitted, the amount of charge to deposit on the toner becomes short.

SUMMARY OF THE INVENTION

It is, therefore, an object of the present invention to provide an image forming apparatus which eliminates the need for a sponge roller or similar developer supply member to reduce the size and cost thereof, prevents a developer from aggregating in the vicinity of a developer carrier, and stabilizes the deposition of a charge on the developer deposited on the developer carrier.

In accordance with the present invention, a developing device for developing a latent image formed on an image carrier with a developer supplied has a developer carrier conveys the developer deposited thereon to the image carrier. A developer driving section moves, in a position adjoining the developer carrier and where the developer is at least apt to aggregate, the developer such that the developer is loosened. A developer charging member deposits a predetermined amount of charge on the developer. The developer charging member is located downstream of the developer driving section with respect to the direction of rotation of the developer carrier and upstream of a developing position where the developer carrier faces the image carrier. The device is small size and inexpensive since it does not include a conventional sponge roller or similar developer supply member. In addition, the device prevents the developer from aggregating in the vicinity of the developer carrier and stabilizes the deposition of a charge on the developer carried on the developer carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
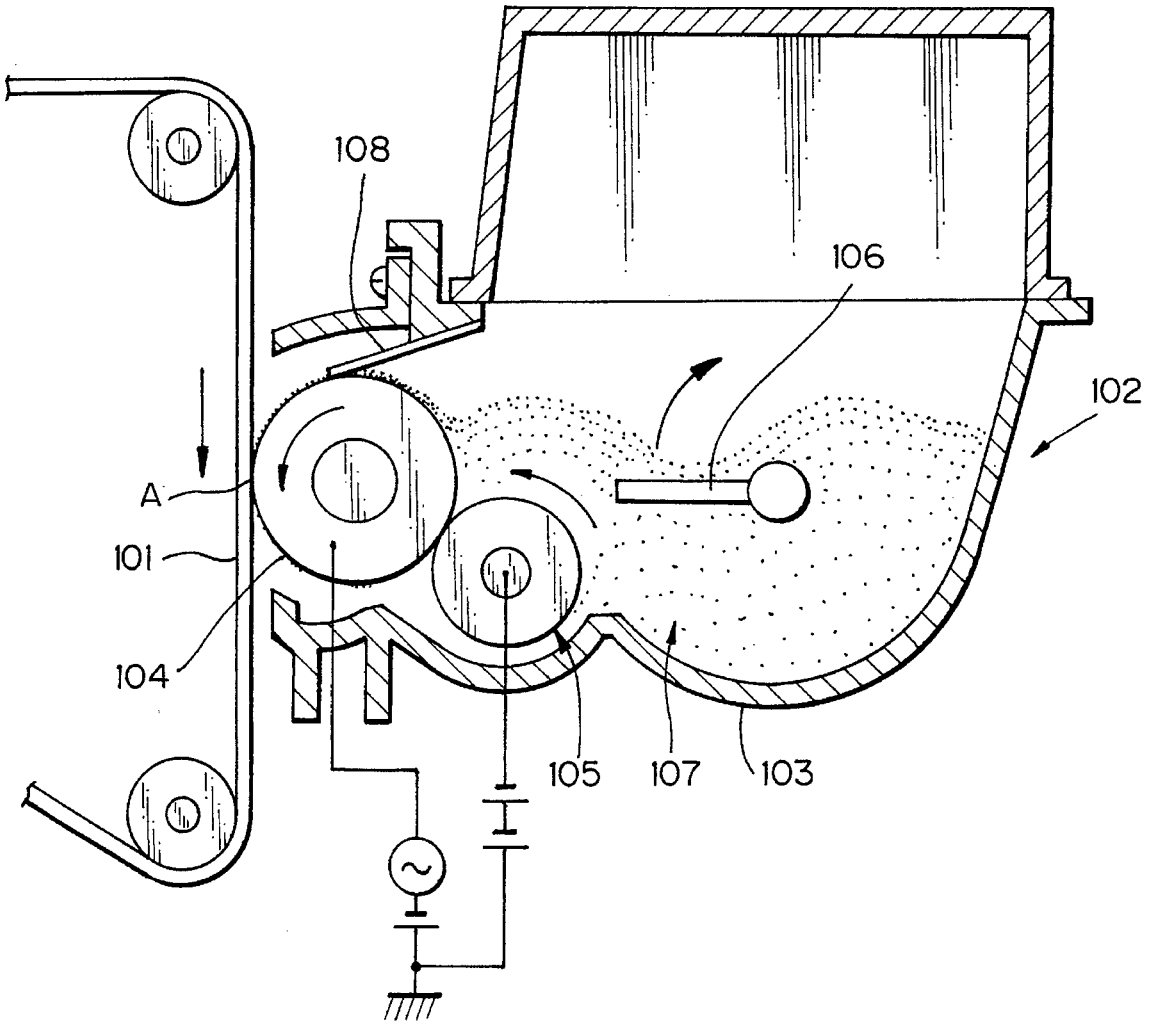
Fig. 1 PRIOR ART
FIG. 1 is a section showing a conventional developing device.

To better understand the present invention, a brief reference will be made to a conventional developing device taught in previously mentioned Japanese Patent Laid-Open Publication No. 2-15110. As shown in FIG. 1, the developing device, generally 102, has a developing roller, or developer carrier, 104 whose surface is made up a conductive portion connected to ground and dielectric portions distributed in the conductive portion in a regular or irregular pattern. The dielectric portions each has a small area. A sponge roller, or developer supply member, 105 is rotatable in contact with the surface of the developing roller 104. A toner 107 is frictionally charged by the two rollers 104 and 105 contacting each other. At the same time, the dielectric portions of the roller 104 are frictionally charged by the roller 105 and toner 107 to form a great number of microfields in the vicinity of the surface of the roller 104. As a result, the frictionally charged toner 107 is deposited on the roller 104 in multiple layers by the microfields. With this arrangement, the developing device achieves an amount of toner deposition and an amount of charge necessary for development while rotating an image carrier and the developer carrier 104 at the same peripheral speed. There are also shown in the figure a casing 103, an agitator 106, a blade 108, a photoconductive belt or image carrier 101, and a developing region A where the developing roller 104 faces the belt 101.

The problem with the developing device 102 is that the sponge roller 105 increases the cost of the device 102 and needs an extra space for installation, as stated earlier. Moreover, the sponge roller 105 requires an extra driving force, and the force necessary for the developing roller 104 to be driven is increased due to the friction between the rollers 104 and 105. Should the sponge roller 105 be omitted to reduce the size and cost of the device 102, the toner 107 would be aggregated below the developing roller 104, resulting in short toner supply.

Figure 2:
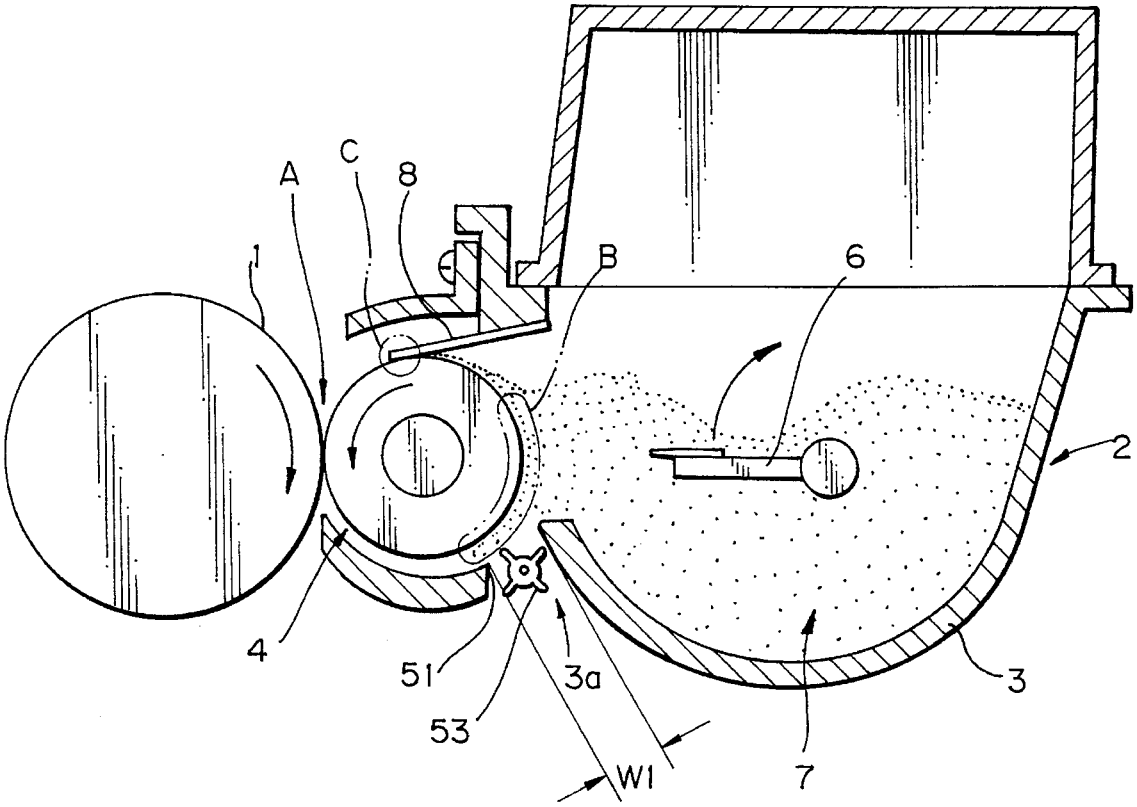
FIG. 2 is a section showing a developing device embodying the present invention.
Figure 3:
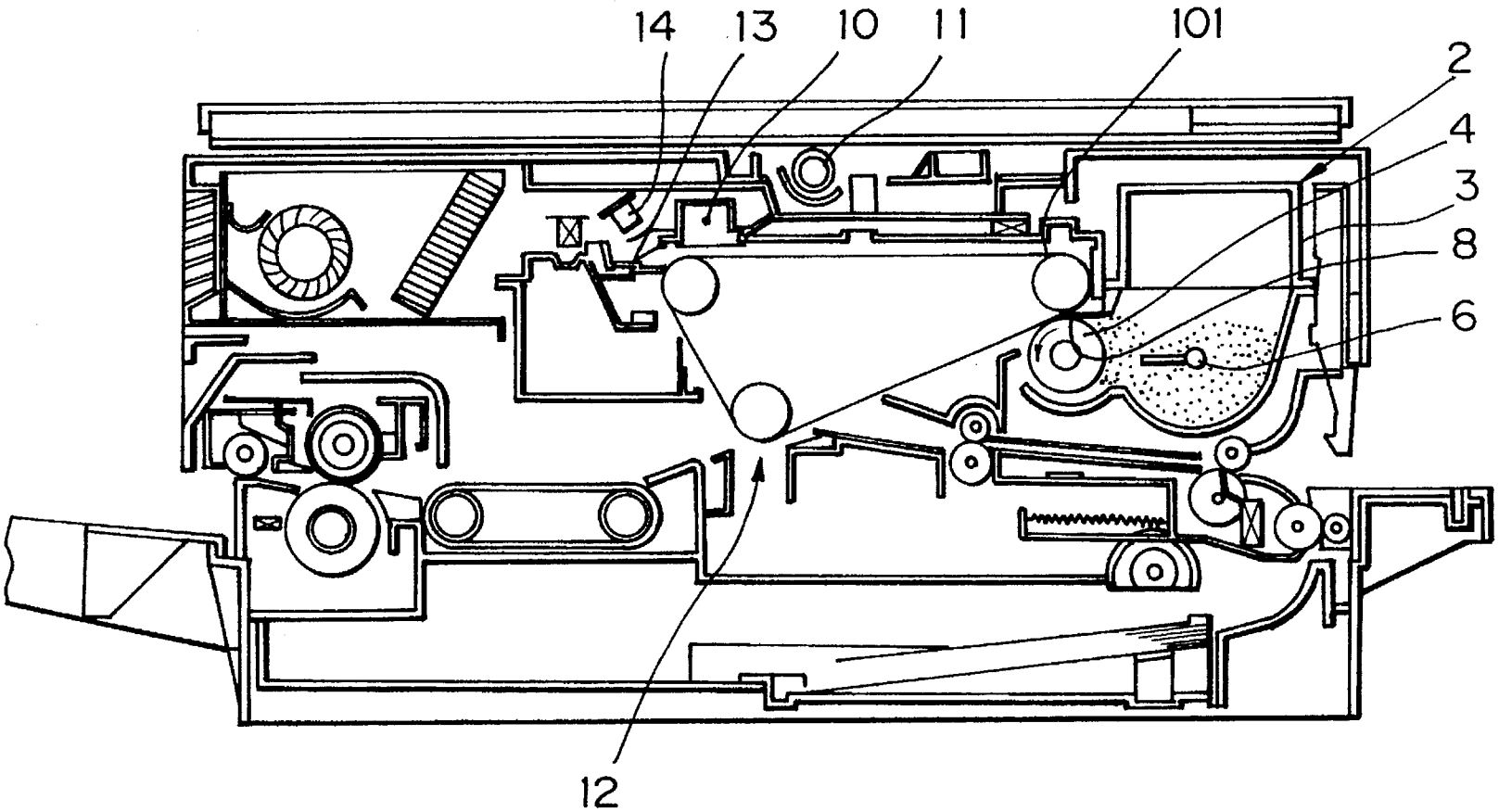
FIG. 3 is a section of an electrophotographic copier belonging to a family of image forming apparatuses and to which the embodiment is applied.

Referring to FIG. 2 of the drawings, a developing device embodying the present invention is shown and generally designated by the reference numeral 2. FIG. 3 shows the general construction of an electrophotographic copier belonging to a family of image forming apparatuses and implemented with the developing device 2. As shown, a photoconductive element, or image carrier, 1 is implemented as a drum and rotated clockwise, as indicated by an arrow, at a peripheral speed of, for example, 120 mm/sec. The drum 1 may, of course, be replaced with a photoconductive belt 101 shown in FIG. 3. The developing device 2 is located at the right-hand side of the drum 1, as viewed in the figure. As shown in FIG. 3, a main charger 10, optics including a lamp 11 for exposure, an image transfer and paper separation unit 12, a cleaning unit 13, a discharger 14 and other conventional units for implementing an electrophotographic process are arranged around the drum 1 or the belt 101.

As shown in FIG. 2, the developing device 2 has a casing 3 formed with an opening which faces the drum 1. A developing roller 4 is accommodated in the casing 3 and partly exposed to the outside through the opening of the casing 4. The roller 4 is rotated counterclockwise, as indicated by an arrow, at a predetermined peripheral speed. A hopper (no numeral) is contiguous with the right end of the casing 3 and plays the role of developer storing means storing a non-magnetic one component type developer, i.e., toner 7 therein. An agitator 6 is disposed in the hopper and rotated clockwise, as indicated by an arrow, to agitate the toner 7 while feeding it to the surface of the developing roller 5. An elastic blade, or developer regulating member, 8 levels the toner deposited on the developing roller 4 in a layer and being conveyed by the roller 4 to a developing region A where the roller 4 faces the drum 1. In the developing region A, the roller 4 may be spaced a predetermined distance from the drum 1 to effect non-contact development or may be so positioned as to cause the toner layer to contact the drum 1 for contact development.

The prerequisite with development, whether it be contact development or not, is that the toner be prevented from concentrating at the trailing edge of an image. To meet this requisite, the developing roller 4 is rotated such that the surface thereof moves in the same direction as the drum 1 in the developing region A and at substantially the same peripheral speed as the drum 1, i.e., at about 120 mm/sec in the illustrative embodiment. However, in the case of contact development, if the roller 4 is rotated at exactly the same peripheral speed as the drum 1, the toner is apt to deposit on the drum 1 without regard to the surface potential of the drum 1. To eliminate this problem, the roller 4 is rotated at a slightly higher peripheral speed than the drum 1. For example, the roller 4 should preferably be rotated at a peripheral speed ratio of 1.05 to 1.1 to the drum 1. Such a ratio is successful in eliminating the above-mentioned phenomenon which would degrade image quality.

The developing roller 4 is applied with a suitable bias voltage for development, e.g., DC, AC, DC-biased AC, or pulse voltage. Particularly, for non-contact development, it is preferable to apply a voltage including an alternating component (AC, DC-biased AC or pulse voltage) in respect of the flight of the toner.

Figure 4A:
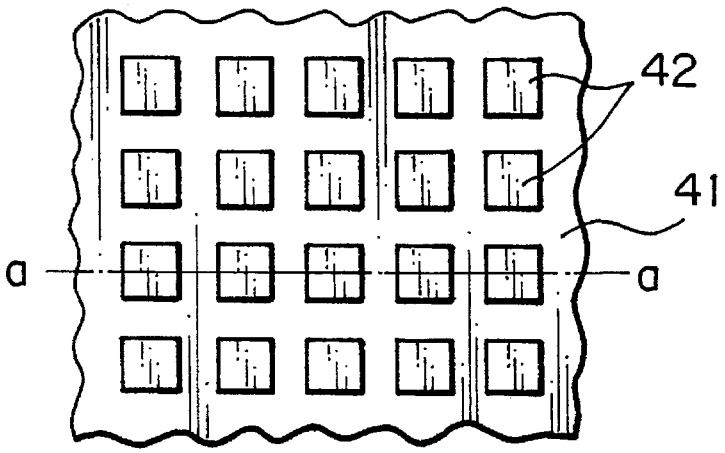
FIGS. 4A and 4B are respectively a fragmentary plan view and a section showing the surface of a developing roller included in the embodiment.
Figure 4B:
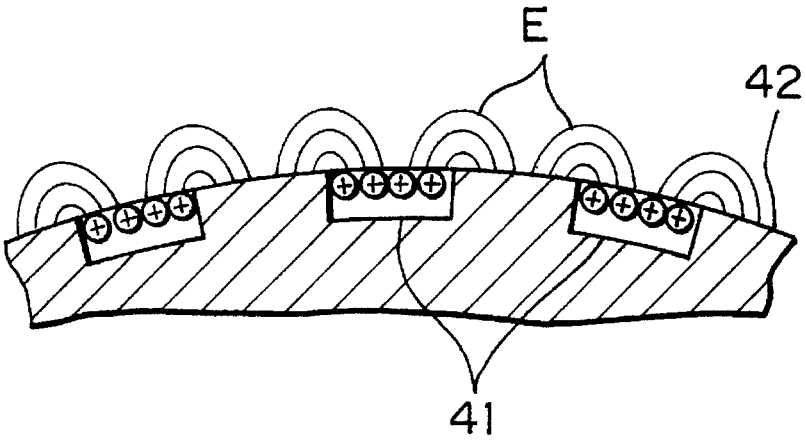

In the illustrative embodiment, the developing roller 4 has a surface made up of a conductive portion connected to ground and small dielectric portions distributed in the conductive portion in a regular or irregular pattern. The dielectric portions are provided with a diameter of, for example, about 50 μm to 200 μm and distributed over the entire surface of the roller 4 either randomly or according to a certain rule. Preferably, the dielectric portions should occupy about 40% to 70% of the entire surface of the roller 4. FIGS. 4A and 4B show a specific configuration of the developing roller 4. Specifically, FIG. 4A shows the knurled surface of a developing roller **4*a* while FIG. 4B shows it in a section along line a—a of FIG. 4A. To form the surface layer shown in these figures, the surface of, for example, a metallic core in the form of a roller is knurled to form predetermined grooves, coated with an insulating material, e.g., resin, and then machined. As a result, the metallic core and the resin filling the grooves appear on the surface to constitute the conductive portion 42 and the dielectric portions 41**, respectively.

The blade 8 is so positioned as to press against the developing roller 4 at a pressure as low as about 10 g/cm$^2$ to 20 g/cm$^2$ in the case of non-contact development or at a pressure as high as about 30 g/cm$^2$ in the event of contact development. For contact development, such a relatively high contact pressure is selected since the toner is transferred from the roller 4 to the drum 1 at a relatively high ratio and, therefore, the adequate amount of toner deposition on the roller 4 is relatively small, e.g., 0.8 mg/cm$^2$ to 1.0 mg/cm$^2$. The blade 8 should preferably be made of a material intervening between the material of the toner and that of the dielectric portions 41 with respect to charge series. Although the agitator 6 is used to feed the toner 7 to the roller 4 while agitating it, the agitator 6 is omissible if the toner 7 can be supplied to the roller 4 by gravity due to, for example, the configuration of the hopper and the fluidity of the toner.

A binding resin included in the toner 7 may be implemented by any one of the conventional binders for toners. The binders include polystyrene, styrene-acrylic acid copolymer, styrene-metacrylic acid copolymer, styrene-acrylic acid ester copolymer, styrene-metacyl acid ester copolymer, styrene-butadien copolymer and other styrene-based resins, saturated polyester resin, unsaturated polyester resin, epoxy resin, phenol resin, maleic acid resin, cumarone resin, paraffine, chlorinated paraffine, xylene resin, vinyl chloride resin, polypropyrene, and polyethyrene. Of course, two or more of these binding resins may be mixed together. In the illustrative embodiment, the toner 7 is advantageously implemented by polystyrene-based resin, styrene-based resin, or epoxy-based resin.

The toner 7 further contains a coloring agent which can be implemented by any one of conventional pigments and dyes for toners. The pigments and dyes include carbon black, lamp black, iron black, ultramarine, Nigrosine, Aniline Blue, Chalco Oil Blue, Dupont Oil Red, Kynurine Yellow, Methylene Blue Chloride, Phthalocyanine Blue, Phthalocyanine Green, Hansa Yellow, Rhodamine 6C Lake, Chrome Yellow, quinacridone, Benzidine Yellow, Malachite Green, Malachite Green Hexalate, oil black, Azooil Black, Rose Bengal, monoazo-based dyes, trisazo-based dyes and pigments, and their mixtures.

A charge control agent, fluid agent or parting agent may also be included in the toner 7, if necessary. When the toner 7 should be charged to positive polarity, the charge control agent may be selected from a group consisting of Nigrosyanine-based dyes, 4-ammonium salts, basic dyes, amino acid-containing polymers, etc. When the toner 7 should be charged to negative polarity, as in the embodiment, use may be made of chrome monoazo-containing dyes, chloro-containing organic dyes, and metal salts of salicylic acid derivatives. For the fluid agent, use may be made of $SiO_2$, $TiO_2$ or similar inorganic acid provided with a hydrophobic surface, SiO or similar inorganic particles, or zinc stearate or similar metallic soap. Further, the parting agent may be selected from a group of synthetic waxes including polyethyrene and polypropyrene of low molecular weight; a group of vegetable waxes including candelilla wax, carnauba wax, and rice wax; a group of animal waxes including bees wax, hydrous lanoline, and whale wax; a group of mineral waxes including montan wax and ozokerite; and a group of fat waxes including hardened castor oil, hydroxystearic acid, and ester of phenolic fatty acid.

Moreover, various kinds of plasticizers (e.g. dibutyl phthalate and dioctyl phthalate), resistance adjusting agents (e.g. tin oxide, lead oxide and antimon oxide) and other auxiliary agents may be added to the toner 7 for adjusting the thermal, electrical and physical characteristics of the toner 7.

Since the toner 7 has to be charged rapidly in a predetermined amount by frictional charging, it should have low resistivity. However, excessively low resistivity would obstruct image transfer. Preferably, therefore, the resistivity should be higher than $1\times10^8$ Ωcm and lower than $1\times10^{12}$ Ωcm. While the resistivity of the toner 7 may be adjusted by the above-mentioned agent, it is adjusted in combination with the selection of resin resistance, additives to be applied to the outer periphery of the toner 7, and parting agent.

The toner 7 selected has an aggregation degree of greater than 5% and smaller than 30%. When the degree of aggregation is lower than 5%, it is likely that the toner 7 flies away from the developing roller 4 and the image is blurred. When the degree of aggregation is greater than 30%, it is difficult to deposit the toner 7 in multiple layers by the gradient force or similar electrostatic force. In addition, the degree of aggregation greater than 30% lowers the developing efficiency, i.e., the ratio of toner transfer from the developing roller 4 to the drum 1, resulting in low image density or irregular density distribution.

To frictionally charge the toner 7 efficiently, as many of the toner particles as possible should contact the developing roller 4 and blade 8. The surface roughness of the roller 4 and blade 8 in their contact portions should preferably be less than one half of the particle size of the toner 7.

Specific configurations of the illustrative embodiment are as follows.

(1) Developing Roller 4

A metallic core in the form of a roller was made of aluminum and had a diameter of 20 mm. The surface of the roller was knurled to form U-shaped grooves in a cross-hatch pattern at a pitch of 0.25 mm. The grooves were 0.15 mm deep and 0.08 mm wide. The knurled surface of the roller was coated with epoxy denaturated silicone resin (SR2115 available from Toray (Japan)), and then dried for 30 minutes at 100° C. to form a dielectric coating. Subsequently, the surface of the roller was machined to cause the core and the resin filling the grooves to appear on the surface to constitute the conductive portion 42 and the dielectric portions 41, respectively. The conductive portion 42 occupied 50% of the total area of the roller surface, i.e., the dielectric portions 41 occupied the other 50%.

(2) Elastic Blade 8

A resilient plate, which was 2 mm thick and had a hardness of JIS (Japanese Industrial Standard) 50 degrees to 70 degrees, was pressed against the developing roller 4 at a pressure of 10 g/cm$^2$ to 20 g/cm$^2$. To produce the elastic plate, carbon black, alkali metal or similar conductive agent was added to and dispersed in urethane rubber whose resistivity was 103 Ωcm to 106 Ωcm, and then molded.

(3) Bias Voltage & Gap for Development

For non-contact development, an AC bias on which a DC −500 V was superposed and having a peak-to-peak voltage of 100 V and a frequency of 1000 Hz was applied to the developing roller 4 (a DC bias of 800 V may be applied, if desired). A gap for development was selected to be 150±30 μm.

(4) Photoconductive Element 1

An organic photoconductor (hard type) was used. The element 1 was uniformly charged such that, in the case of a negative latent image for negative-to-positive development, the voltage was −850 V in the background and −150 V in the image area.

(5) Toner 7

Use was made of a negatively chargeable toner made of a combination resin of non-magnetic styrene acryl and polyester. 0.7 Wt % of fine silicon dioxide ($SiO_2$) powder was added to the outer periphery of the combination resin.

The operation of the developing device 2 will be outlined hereinafter.

The elastic blade 8 rubs against the surface of the developing roller 4 either directly or via the toner 7 in a region C, FIG. 2. The dielectric portions 41 of the roller 4 were changed to a polarity opposite to the polarity of the toner 7 by the friction of the roller 4, toner 7, and blade 8. Specifically, the dielectric portions 41 are changed to the same polarity as the drum 1 in the case of positive-to-positive (regular) development or to the opposite plurality to the drum 1 in the case of negative-to-positive (reversal) development. As a result, microfields are developed on the roller 4, as represented by electric lines of force E in FIG. 4B.

On the other hand, the agitator 6 feeds the toner 7 from the hopper to a region B, FIG. 2, adjoining the developing roller 4. In the region B, the non-charged or weakly charged toner 7 is deposited on the surface of the roller 4 in multiple layers due to a gradient force or similar electrostatic force exerted by the microfields of the roller 4. A gradient force is taught in Ueda et al "Fundamentals of Static Electricity", Asakura Publishing Company, page 15, 1971. The roller 4 carrying the toner 7 thereon is rotated to the region C where the blade 8 contacts it. The blade 8 levels the toner 7 to form a thin toner layer having a predetermined thickness. Such a toner layer is brought to the developing region A by the roller 4. In the illustrative embodiment, the blade 8 plays the role of a developer charging means at the same time, as will be described in detail later; the charging means deposits an amount of charge necessary for development on the toner 7 existing between it and the roller 4. At this instant, the toner 7 is deposited on the roller 4 in an amount of 1.0 mg/cm$^2$ to 1.6 mg/cm$^2$ and provided with a charge of −5 μc/g to −15 μc/g. In the developing region A, the surface of the roller 4 applied with an optimal bias and the surface of the drum 1 move at substantially the same speed as each other to effect contact or non-contact development.

When a sponge roller or similar developer supply member is not used, as in the embodiment, it is likely that the toner 7 is aggregated below the developing roller 4, resulting in short toner supply to the roller 4 or short charge of the toner 7 on the roller 4. To eliminate this problem, as shown in FIG. 2, the embodiment has developer driving means made up of a flexible polyester film 51, a movable member 53, and means for driving the movable member 43. The developer driving means moves the toner 7 aggregated or about to be aggregated below the roller 4 such that it oscillates or waves. It has been customary to frictionally charge the toner 7 on the roller 4 by a sponge roller or similar developer supply member. By contrast, in the embodiment, the blade 8 also serves as developer charging means located downstream of the developer driving means and upstream of the developing region A with respect to the direction of rotation of the roller 4.

The developer driving means is constructed and arranged as follows. A part of the casing 3 facing the lower periphery of the developing roller 4 is formed with an opening 3*a*. The polyester film 51 is affixed to the casing 3 to close the opening 3*a*. Specifically, the film 51 may be directly fitted on the inner periphery of the casing 3 by, for example, a two-sided adhesive tape 52, as shown in FIG. 2, or may be adhered to a separate member which is to be affixed to the casing 3. While the film 51 is 0.125 mm thick in the illustrative embodiment, the thickness t preferably lies in the range of from 0.1 mm to 0.2 mm since the accuracy of assembly and the degree of noise depend on the thickness t, as shown in Table 1 below.

TABLE 1

| THICKNESS (mm) | RESULT | OCCURRENCE |
|---|---|---|
| 0.05 | X | too soft and requiring accurate adhesion; failing to contact member 53 if dislocated |
| 0.1 | ○ | good |
| 0.125 | ○ | good |
| 0.188 | ○ | good |
| 0.2 | Δ | too soft and vibrating with some noise |
| 0.3 | X | too hard and vibrating with great noise |

The polyester film 51 may be replaced with urethane rubber, in which case the thickness t should preferably lie in the range of from 0.2 mm to 0.3 mm.

Why the embodiment uses the polyester film 51 as the flexible member is that it is one of the commonest and inexpensive flexible members and prevents the toner from being transferred thereto without regard to the kind of the toner. It follows that the polyester film 51 eliminates problems attributable to the kind of a toner.

Figure 5A:
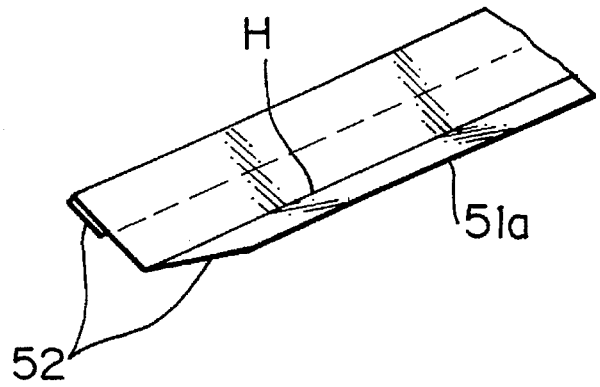
FIGS. 5A and 5B are perspective views each showing a specific modification of a polyester film also included in the embodiment.
Figure 5B:
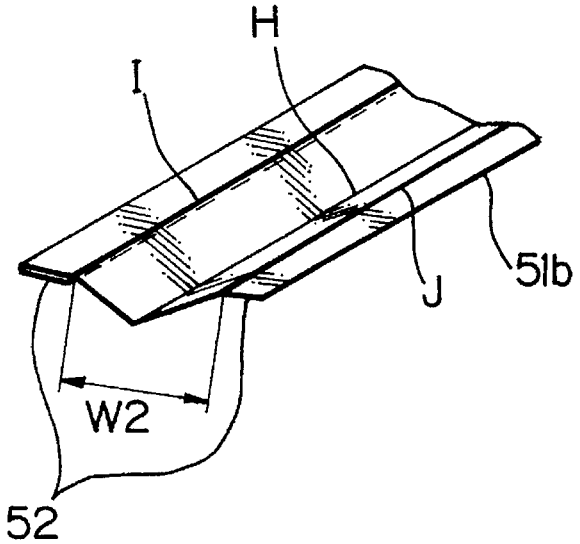

The movable member 53 contacts the polyester film 51 from the outside of the developing device 2. FIG. 5A shows a modification which ensures the contact of the movable member 53 with the film 51. As shown, a polyester film 51*a* is bent along an imaginary line H parallel to the axis of the developing roller 4 such that the film 5 is convex toward the movable member 53. FIG. 5B shows another modification in which a polyester film 51*b* is bent along imaginary lines I and J as well as along the line H; the portion of the film 51*b* between the lines I and J is engaged with the opening 3*a* of the casing 3. In the modification of FIG. 5B, the distance w2 between the lines I and J is selected to be slightly smaller than or substantially equal to the width w1 of the opening 3*a*. In the illustrative embodiment, the dimensions w1 and w2 are 1.5±0.2 mm and 14.5±0.2 mm, respectively.

Figure 6A:
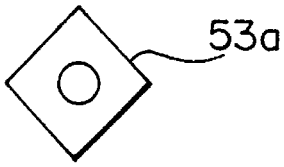
FIGS. 6A, 6B, 7, 8 and 9 each shows a specific configuration of a movable member also included in the embodiment.
Figure 6B:
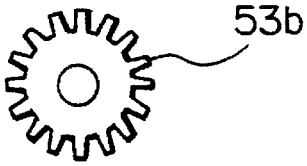
Figure 7:
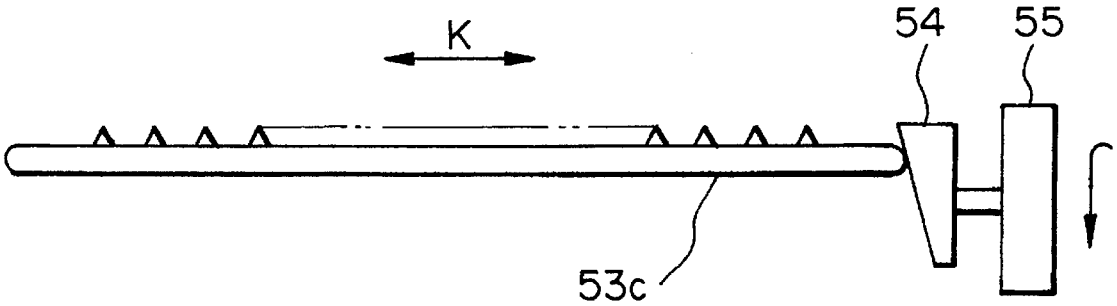

In FIG. 2, the movable member 53 is provided with four blades. If desired, the movable member 53 may be replaced with a movable member 53*a* (see FIG. 6A) having a square cross-section or a gear-like movable member 53*b* (see FIG. 6B) having a number of blades. Further, as shown in FIG. 7, a movable member 53*c* having a number of projections on the side thereof that faces the film 51 may be arranged such that it moves in a reciprocating motion in a direction substantially parallel to the axis of the developing roller 4, as indicated by an arrow K in the figure. The movable member 53*c* is moved back and forth by the movable member driving means which may be constituted a cam 54 and a gear 55. Alternatively, the movable member 53*c* may be driven by a solenoid.

Figure 8:
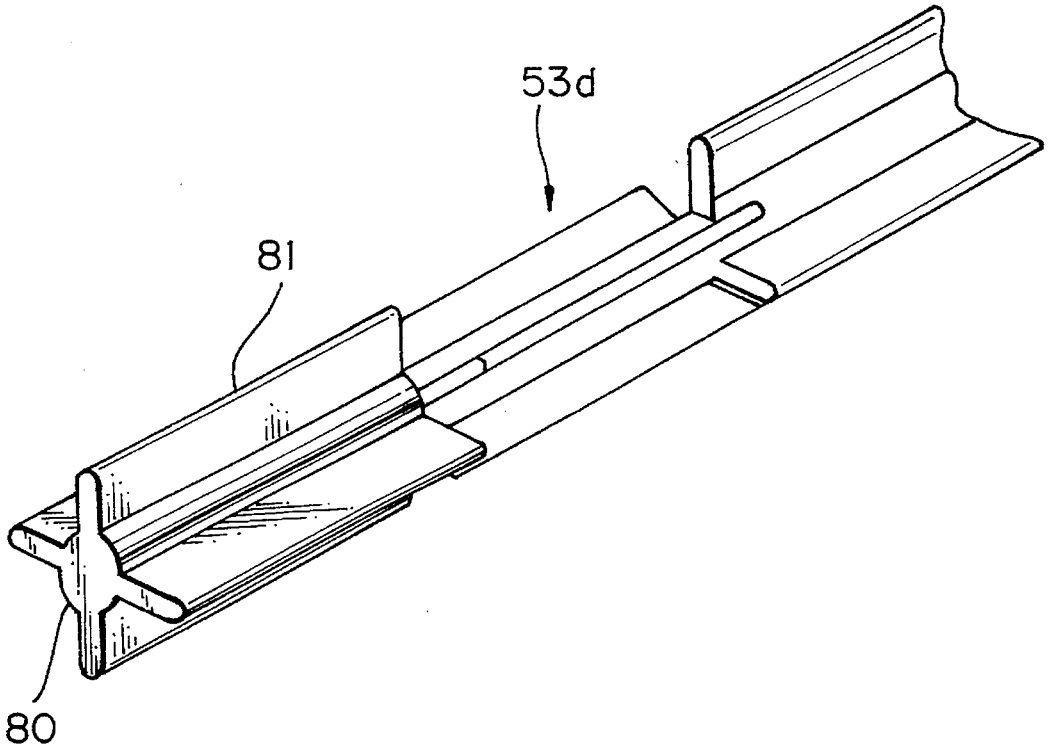

FIG. 8 shows another specific configuration of the movable member 53. As shown, a movable member 53*d* has a shaft 80 and, for example, four blade members 81 which are divided in the axial direction of the shaft 80 to have a predetermined length each. Each group of blade members 81 are deviated from the next group of blade members 81 in the circumferential direction of the shaft 80.

Figure 9:
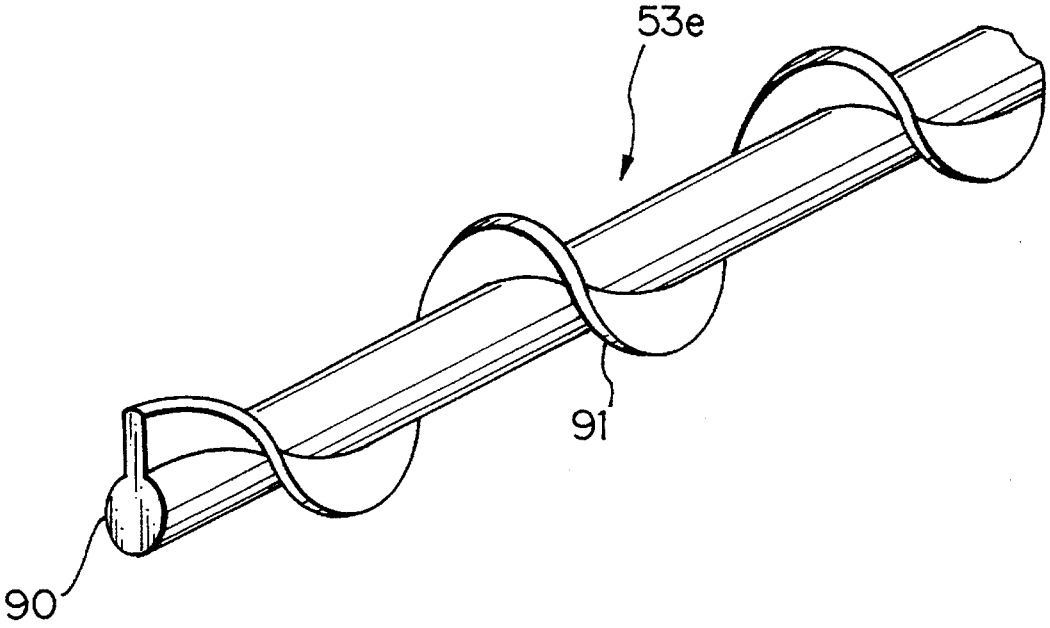

FIG. 9 shows still another specific configuration of the movable member 53. As shown, a movable member 53*e* has a shaft 90 and a spiral blade member 91 provided on the shaft 90.

Figure 10:
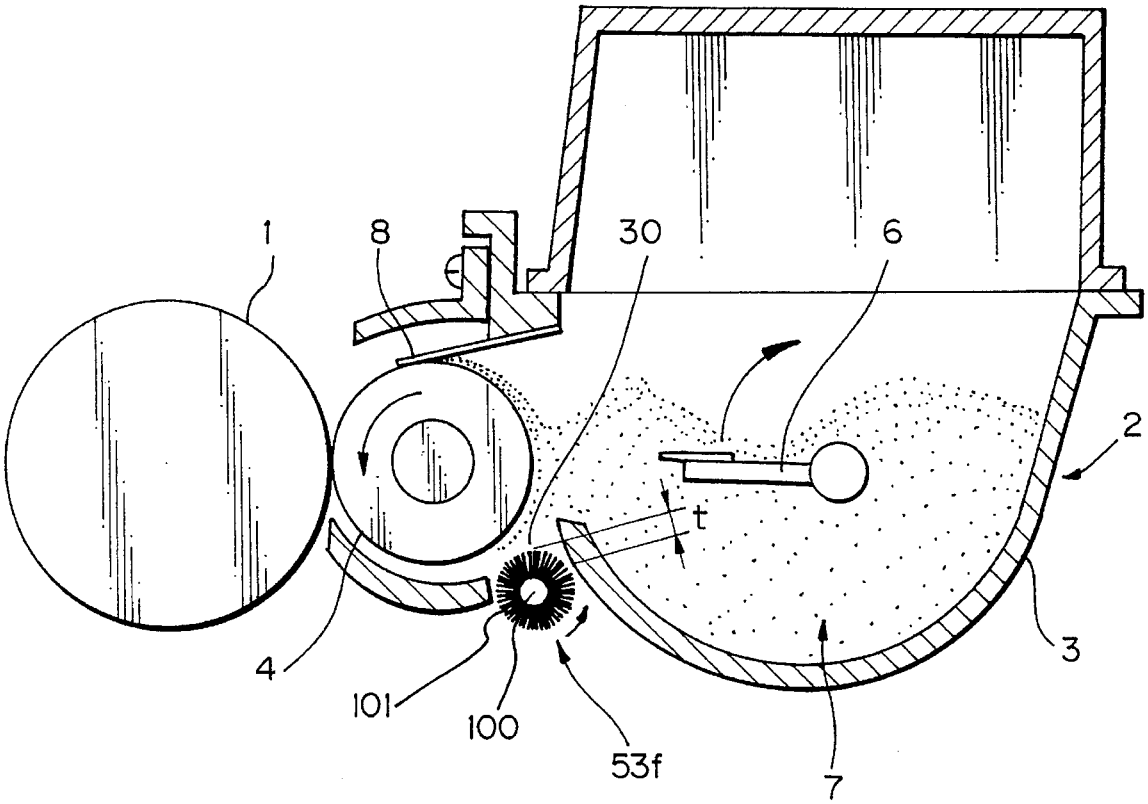
FIG. 10 shows a developing device implemented with another specific configuration of the movable member.

FIG. 10 shows a further specific configuration of the movable member 53. As shown, a movable member **53*f* has a shaft 100 and a number of filament-like members 101 implanted in the shaft 100. Generally, some toners are apt to aggregate more than the others. FIG. 10 also shows an implementation for preventing this kind of toner from aggregating. Specifically, the casing 3 has an edge 30 at the upstream side, with respect to the direction of rotation of the movable member 53*f*, of the position where the movable member 53*f* contacts the polyester film 51. The edge 30 of the casing 3 is provided with a step, which serves as an abutment member, such that the filaments 101 sequentially abut against the step in such a manner as to run thereonto. This is successful in further increasing the pressure at which the filaments 101 contact the film 51. Stated another way, the degree of aggregation of the toner is, in an apparent sense, reduced to maintain the toner around the developing roller 4 loose at all times. This allows the toner to be supplied in a stable manner. In FIG. 10, the edge 30 of the casing 3** has a thickness t which constitutes the above-mentioned step.

Figure 11:
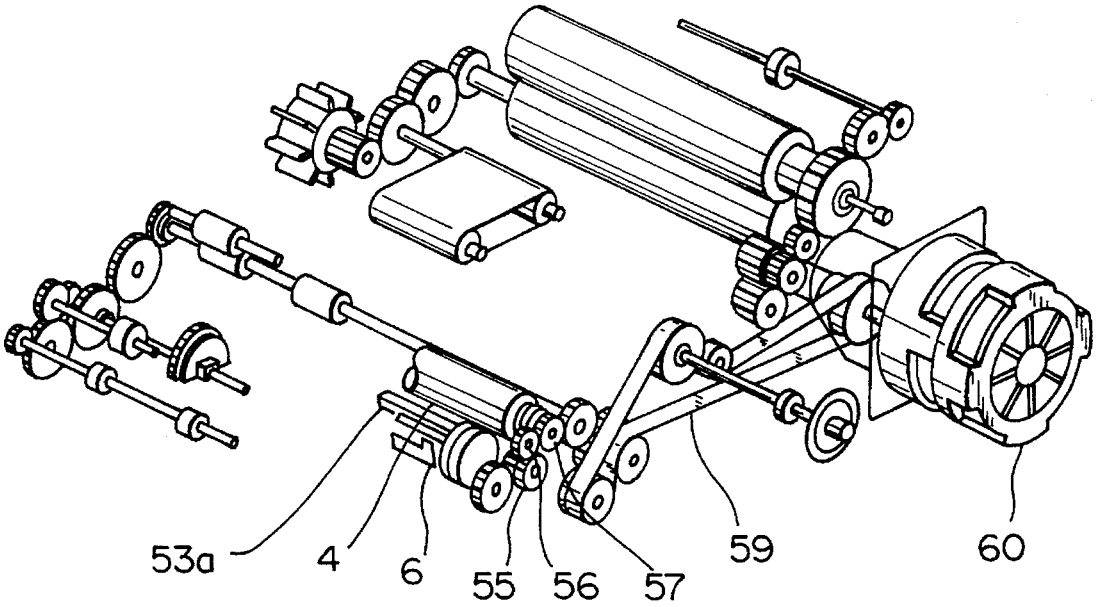
FIGS. 11 and 12 are perspective views each showing a specific arrangement of movable member driving means also included in the embodiment.
Figure 12:
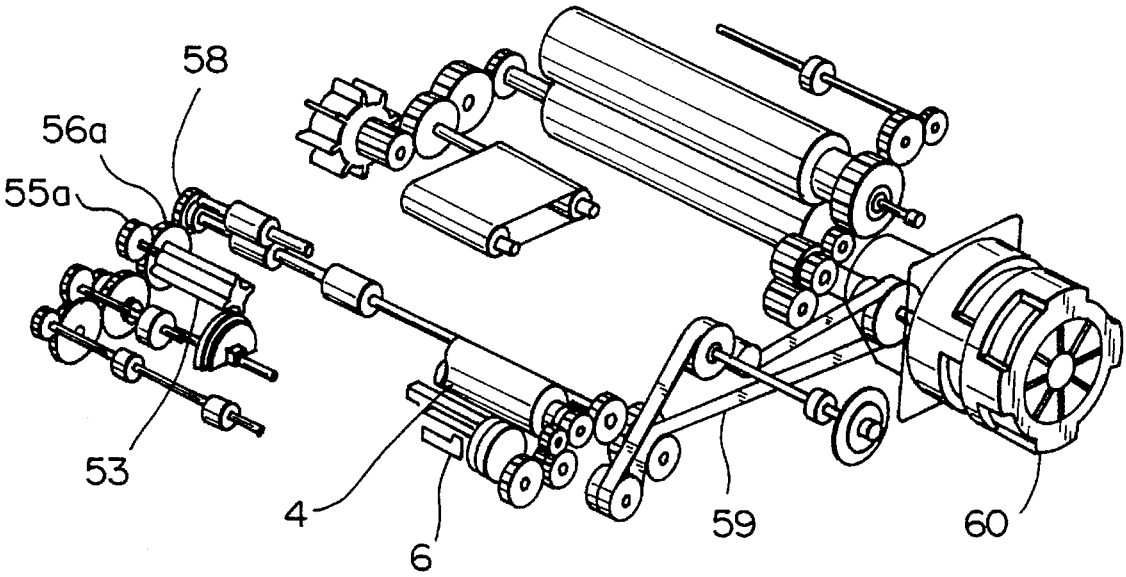

As shown in FIG. 11, the movable member driving means for driving the movable member 53 includes the previously mentioned gear 55. The gear 55 is mounted on one end of the movable member 53 and held in mesh with an idler gear 56. The idler gear 56 is held in mesh with a gear 57 which is mounted on the developing device 2 for driving the developing roller 4. If desired, the movable member 53 and associated driving means may be located at the outside of the developing device 2, i.e., on the copier body. For example, as shown in FIG. 12, a gear **55*a* may be mounted on the end of the movable member 53 mounted on the copier body. The gear 55*a* is meshed with an idler gear 56*a* which is in turn meshed with a registration roller gear 58** also mounted on the copier body.

Further, in the embodiment, the blade 8 is used as the developer charging means for depositing a predetermined amount of charge on the toner 7. The blade 8 is also used to frictionally charge the dielectric portions 41 of the developing roller 4.

Figure 13A:
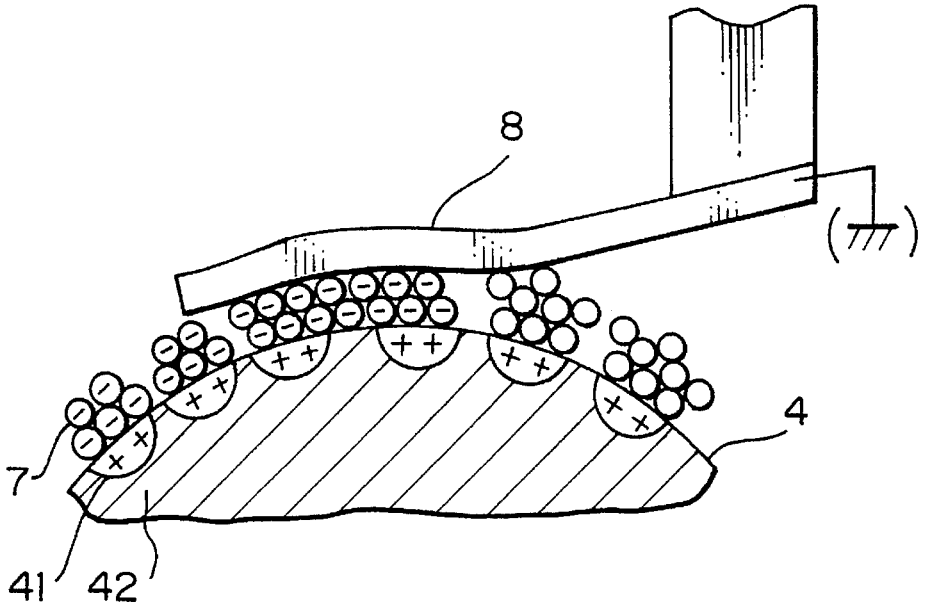
FIGS. 13A and 13B are enlarged views each showing a position where the developing roller contacts an elastic blade in a particular condition.
Figure 13B:
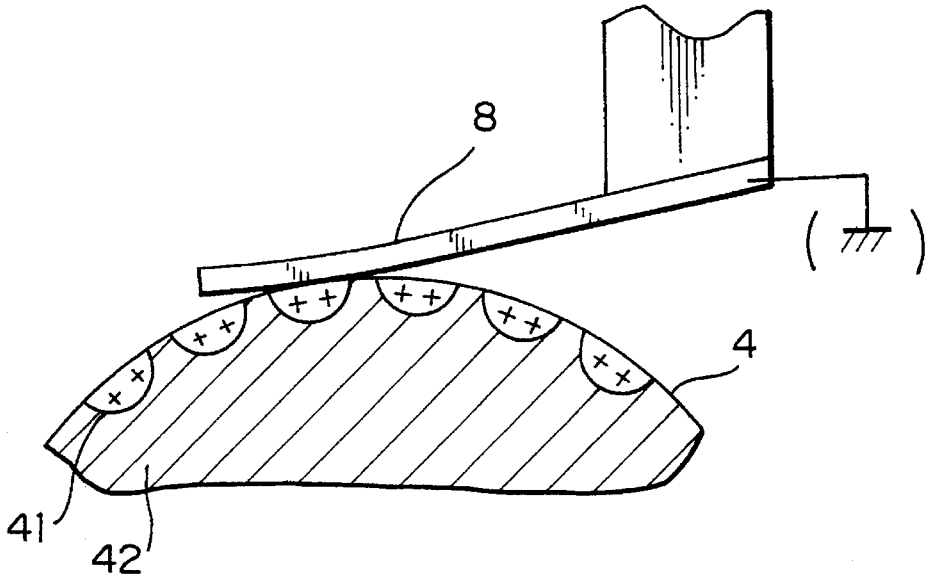

What is important in frictionally charging the toner 7 and dielectric portions 41 in the region C, FIG. 2, is the relative position of the blade 8, toner 7, and dielectric portions 41 with respect to frictional charge series. FIGS. 13A and 13B show the region C in an enlarged scale. FIG. 13A is representative of a condition wherein the toner 7 is deposited on the developing roller 4 in a sufficient amount during usual development. FIG. 13B is representative of a condition wherein the amount of toner deposition is short or wherein the roller 4 and blade 8 directly contact each other, e.g., before the toner 7 is deposited on the roller 4. It is preferable to frictionally charge the toner 7 and dielectric portions 41 efficiently in both the condition of FIG. 13A and the condition of FIG. 13B.

Assume that negative-to-positive development is effected by the toner 7 which is chargeable to negative polarity, as in the embodiment. Then, the blade 8 should preferably be implemented by a material assuming a particular position in frictional charge series which will be described. The concept to be described also applies to the toner 7 which is chargeable to positive polarity.

Figure 14A:
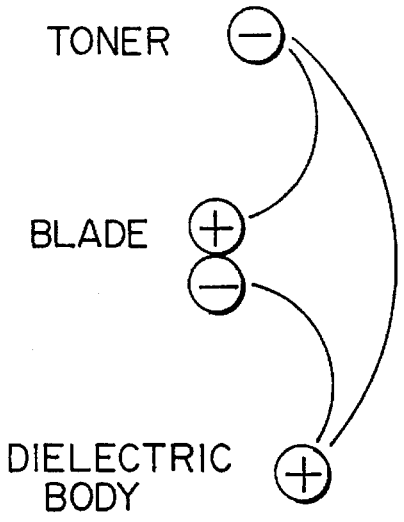
FIGS. 14A–14D each shows a specific relation between the toner, blade, and dielectric and conductive bodies forming part of the developing roller with respect to a frictional charge series.
Figure 14B:
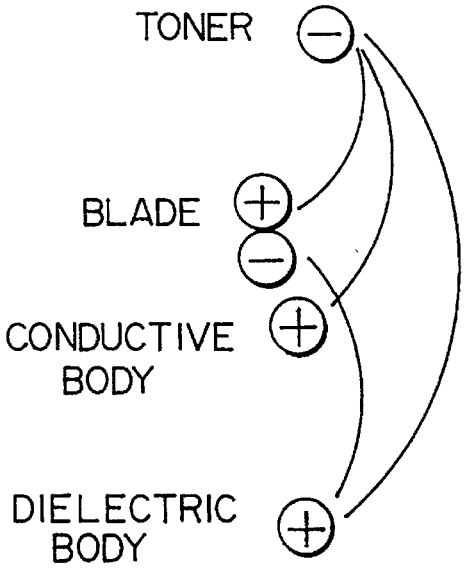
Figure 14C:
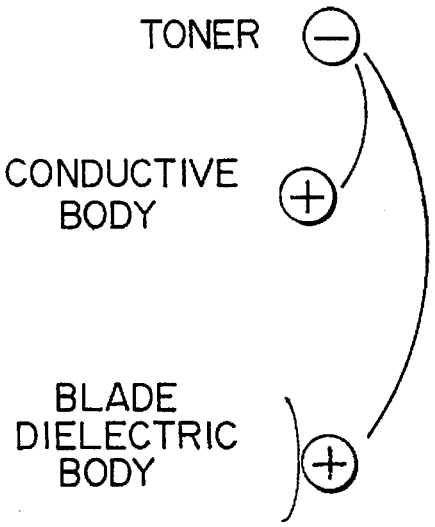
Figure 14D:
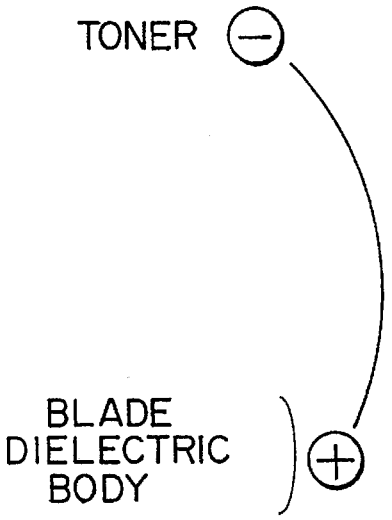

As shown in FIG. 14A, when the blade 8 is made of a conductive material, the blade 8 is so conditioned as to intervene between the toner 7 and the dielectric body, or dielectric portions, 41 with respect to frictional charge series. Alternatively, as shown in FIG. 14B, an arrangement may be made such that the conductive body, or conductive portion, 42 of the blade 4 and the blade 8 assume substantially the same position in frictional charge series, the toner 7 assumes a position easily charged by all of the blade 8, dielectric body 41, and conductive body 42, and the dielectric body 41 is frictionally charged to positive polarity by the blade 8 and toner 7. In any case, since positive and negative charges are deposited on the blade 8, a better result is achieved when the blade 8 is made of a conductive material. In this case, the blade 8 and roller 4 are provided with the same potential. On the other hand, when the blade 8 is not conductive, the charge series is set as shown in FIG. 14C or 14D; the toner 7 is charged solely by the contact thereof with the dielectric body 41 and conductive body 42 of the roller 4.

To stabilize the charging of the toner, a bias voltage of the same polarity as the charge of the toner 7 and 200 V to 300 V higher in absolute value than the potential of the roller 4 may be applied to the blade 8 for charge injection. Then, the blade 8 is required to have a resistivity high enough to maintain such a potential difference, preferably $10^7$ Ωcm to $10^9$ Ωcm.

In the illustrative embodiment, the rotation of a main motor 60, FIG. 11, included in the developing device 2 is transmitted to the movable member 53 via a belt 59 and the gears 57, 56 and 55. As a result, the moveable member 53 is moved in a rotary motion or in a translating motion. Since the movable member 53 is held in contact with the polyester film 51, the film 51 is deformed in such a manner as to oscillate or wave toward the developing roller 4. As a result, the non-charged or weakly charged toner 7 fed from the hopper to the roller 4 by the agitator 6 is moved by the film 51 in an oscillating or waving fashion and, therefore, maintained loose at all times. The loosened toner 7 is prevented from aggregating in the vicinity of the roller 4 and is deposited on the roller 4 by the gradient force or similar electrostatic force exerted by the microfields. The toner 7 on the roller 4 is brought between the roller 4 and the blade 8. Consequently, an amount of charge necessary for development is successfully deposited on the toner 7 by frictional charging, charge injection, etc.

As stated above, the embodiment is practicable without resorting to the conventional sponge roller 105 or similar developer supply member. This reduces the driving force required of the entire developing device by an amount heretofore needed to drive the developer supply member, while reducing the cost. Hence, the developing device 2 is small size and inexpensive. Further, despite that the developer supply member is absent, the toner 7 is prevented from aggregating in the vicinity of the developing roller 4 while a sufficient charge is deposited on the toner 7 carried on the roller 4.

The movable member **53*c* shown in FIG. 7 has the following advantages. The polyester film 53*c* is deformed toward the movable member 53*c* between the nearby projections of the member 53*c* due to the weight of the toner 7. When the movable member 53*c* is moved in the direction substantially parallel to the axis of the roller 4, the toner 7 on the film 51 is moved in such a manner as to wave and then fed to the roller 4 in a loosened state. Consequently, the loose toner 7 is constantly fed to the roller 4 in the direction of rotation of the roller 4 even when the rotation speed of the roller 4 is increased. This ensures a constant amount of toner supply to the roller 4 and, therefore, eliminates an irregular image density distribution. Since the projection of the movable member 53*c* and the film 51 contact each other only over a small area, the frictional resistance and, therefore, the force for driving the member 53***c* is reduced. Consequently, the overall driving force required of the Consequently, the overall driving force required of the developing device 2 is further reduced.

Regarding the movable member 53*d* shown in FIG. 8, the blade members 81, which contact the polyester film 51, sequentially change as the member 53*d* is rotated. Hence, the part of the film 51 to protrude toward the movable member 53*d* sequentially changes in the direction substantially parallel to the axis of the developing roller 4. As a result, the toner 7 on the film 51 is sequentially moved in a waving fashion together with the film 51 and then fed to the roller 4 stably in a loosened state. In addition, the area over which each blade contacts the film 51 is smaller than in the configuration of FIG. 2 wherein four blades extend over the entire length of the shaft. Consequently, the frictional resistance in the entire contact portion is reduced to, in turn, reduce the torque necessary for the movable member 53*b* to be rotated.

The movable member 53*e* shown in FIG. 9 and having the spiral blade 82 is advantageous in the following respect. When the movable member 53*e* is rotated, the portion where the edge of the blade 82 contacts the polyester film 51 is sequentially shifted in the direction substantially parallel to the axis of the developing roller 4. As a result, the part of the film 51 to protrude toward the movable member 53*e* sequentially changes. This causes the toner on the film 51 to move in a waving motion together with the film 51 and, therefore, feeds the toner stably to the roller 4 in a loosened state. Only the edge portions of the blade 82 existing on the same axis contact the film 51 and, therefore, only over a small area, reducing the frictional resistance in the overall contact portion to a significant degree. It follows that the movable member 53*e* is even lower than the movable member 53*d* of FIG. 8 concerning the torque necessary for the movable member to be driven. Furthermore, the edge of the spiral blade 82 constantly contacts the film 51. This is contrastive to the movable member 53 of FIG. 2 which contacts the film 51 intermittently. Consequently, with the spiral blade 82, it is possible to reduce the torque necessary for the movable member 53*e* to be driven and, therefore, to supply the toner to the roller 4 in a stable manner, thereby eliminating defective images, e.g., an image with an irregular density distribution.

The movable member 53*f* shown in FIG. 10 is provided with a number of filament members 101. As the movable member 53*f* is rotated, the tips of the filaments 101 contact with polyester film 51 irregularly, causing the film 51 to oscillate at an irregular period. As a result, the toner supply to the developing roller 4 is irregular to eliminate irregular images ascribable to the oscillation frequency of the film 51. In addition, the movable member 53*f* contacts the film 51 more frequency and, therefore, increases the frequency of oscillation of the film 51. This is successful in reducing the number of rotations of the movable member 53*f* and, therefore, extending the life thereof.

In the configuration of FIG. 10, the edge 30 of the casing 3 may be provided with a step such that the filaments 101 sequentially run onto the step during rotation of the movable member 53*f*, as stated earlier. Then, before the tip of each filament 101 contacts the film 51, it abuts against the step, i.e., the edge 30 of the casing 3 and deforms. Subsequently, as the tip of the filament is released from the edge 30 due to further rotation of the movable member 53*f*, it is elastically restored and strongly hits against the film 51, causing the film 51 to oscillate intensely. As a result, the toner is effectively prevented from aggregating. Stated another way, in an apparent sense, the degree of aggregation of the toner is reduced to maintain the toner in the vicinity of the roller 4 loose at all times.

When use us made of the polyester film 51*a*, FIG 5A, or the polyester film 51*b*, FIG. 5B, it surely contacts the movable member 53 and, there, eases the required accuracy of assembly. Furthermore, as shown in FIGS. 2 and 5B, assume that the portion of the film 51*b* between the lines I and J is engaged with the opening 3*a* of the casing 3, and that the width w2 between the lines I and J is slightly smaller than or substantially equal to the width w1 of the opening 3*a*. Then, when the film 51*b* is to be affixed to the casing 3, the film 51*b* is engaged with the opening 3*a* and, therefore, positioned with ease. This promotes easy assembly of the developing device.

In the arrangement shown in FIG. 12, the movable member driving means and movable member 53 are located at the outside of the developing device 2. Specifically, the rotation of the main motor 60 mounted on the copier body is transmitted to the movable member 53 also mounted on the copier body via the belt 59 and gears 58, 56*a* and 55*a*, causing the member 53 to rotate or translate. Hence, it is not necessary to provide the developing device 2 with an exclusive space for accommodating the driving means and movable member 53. In addition, when the developing device 2 should be replaced frequently, e.g., when the device 2 is adaptive to color development, a person can replace only the device 2 while leaving the driving means and movable member 53 in the copier body. As a result, the size and cost of the developing device 2 are further reduced since it does not include the driving means and movable member 53.

In the illustrative embodiment, the developer driving means is implemented by the deformation of the polyester film 51 caused by the movable member 53. Alternatively, a piezoelectric material may be applied with a voltage to generate oscillation, thereby moving the toner 7 around the developing roller 4. If desired, the means for charging the toner 7 on the roller 4 may be implemented by extra developer charging means separate from the elastic blade 8.

The movable member 53*c* shown in FIG. 7 is provided with a number of projections on the side thereof that faces the polyester film 51, as stated earlier. To cause the film 51 to wave more effectively, the film 51 may be provided with projections and recesses on the surface thereof that faces the movable member 53*c*. Further, the movable member 53*c* may be moved in one direction continuously although it has been shown and described as moving in a reciprocating motion.

The forgoing description has concentrated on a developing device of the type having the developing roller 4 whose surface is constituted by the dielectric portions 41 and conductive portion 42, and using a non-magnetic one component type developer. However, the present invention is similarly practicable with a developing device having a developing roller lacking the dielectric portions 41 and conductive portion 42 e.g., a conductive roller made of metal rubber or similar material, a soft or hard semiconductive roller, a roller provided with a coating for insulation, or a floating electrode roller, or even with a developing device having a developing roller accommodating magnets therein, and using a magnetic one component type developer.

In summary, it will be seen that the present invention provides a developing device having various unprecedented advantages, as enumerated below.

(1) The device does not need a conventional sponge roller or similar developer supply member and, therefore, saves a driving force otherwise required by the developer supply member. In addition, the cost of the device is reduced due to the absence of the developer supply member. Therefore, the device is small in size and inexpensive.

(2) Despite that the developer supply member is omitted, there can be eliminated the aggregation of a developer in the vicinity of a developer carrier and the short charge of the developer deposited on the developer carrier.

(3) Even when the moving speed of the surface of the developer carrier is increased, the developer is supplied to the developer carrier in a constant amount in the moving direction of the surface. This is successful in eliminating irregular image density distributions.

(4) Since a movable member can be driven by a minimum of force, the drive torque which the device needs is reduced.

(5) The torque for driving the movable member changes little and, therefore, does not have any adverse influence on image quality.

(6) Since the supply of the developer to the developer carrier occurs irregularly, there can be eliminated the adverse influence of oscillation period on image quality.

(7) The required frequency of rotation of the movable member is reduced, extending the life of the movable member.

(8) The developer is maintained loose at all times and can be supplied to the developer carrier more stably.

Various modifications will become possible for those skilled in the art after receiving the teachings of the present disclosure without departing from the scope thereof.

What is claimed is:

1. A developing device for developing a latent image carrier with a developer supplied to said device, comprising:

a developer carrier for conveying the developer deposited thereon to said image carrier;

a flexible member facing a surface of said developer carrier and contacting the developer for moving said developer from a position adjoining said developer carrier where said developer is apt to aggregate toward said developer carrier to loosen said developer;

a movable member contacting said flexible member for causing said flexible member to move in an oscillating motion and causing the developer to loosen, said developer charged in frictional contact with the developer carrier and electrostatically deposited and conveyed by the developer carrier, wherein said movable member comprises a plurality of projections convex toward said flexible member and extending in a first direction substantially perpendicular to a second direction in which the surface of said developer carrier moves, said movable member being moved in said first direction;

movable member driving means for driving said movable member; and developer charging means for depositing a predetermined amount of charge on the developer and located downstream of said flexible member with respect to a direction of rotation of said developer carrier and upstream of a developing position where said developer carrier faces said image carrier.

2. A developing device for developing a latent image formed on a image carrier with a developer supplied to said device, comprising:

a developer carrier for conveying the developer deposited thereon to said image carrier;

a flexible member facing a surface of said developer carrier and contacting the developer for moving said developer from a position adjoining said developer carrier where said developer is apt to aggregate toward said developer carrier to loosen said developer;.

a movable member contacting said flexible member for causing said member to move in a oscillating motion and causing the developer to loosen, said developer charged in frictional contact with the developer carrier and electrostatically deposited and conveyed by the developer carrier, wherein said movable member comprises:

a shaft extending in a first direction substantially perpendicular to a second direction in which the surface of said developer carrier moves; and a plurality of blade members provided on said shaft to extend in said first direction and divided in said first direction to have a predetermined length each, a group of said blades divided being deviated, in a circumferential direction of said shaft, from another group of blades adjoining said group in said first direction;

said movable member being rotated about said shaft;

movable member driving means for driving said movable member; and developer charging means for developer a predetermined amount of charge on the developer and located downstream of said flexible member with respect to a direction or rotation of said developer carrier and upstream of a developing position where said developer carrier faces said image carrier.

3. A developing device for developing a latent image formed on an image carrier with a developer supplied to said device, comprising:

a developer carrier for conveying the developer deposited thereon to said image carrier;

a flexible member facing a surface of said developer carrier and contacting the developer for moving said developer from a position adjoining said developer carrier where said developer is apt to aggregate toward said developer carrier to loosen said developer;

a movable member contacting said flexible member for causing the developer to loosen, said developer charged in frictional contact with the developer carrier and electrostatically deposited and conveyed by the developer carrier, wherein said movable member comprises a spiral blade member extending in a direction substantially perpendicular to a direction in which the surface of said developer carrier moves, said movable member being rotated;

movable member driving means for driving said movable member; and developer charging means for depositing a predetermined amount of charge on the developer and located downstream of said flexible member with respect to a direction of rotation of said developer carrier and upstream of a developing position where said developer carrier faces said image carrier.

4. A developing device for developing a latent image formed on an image carrier with a developer supplied to said device, comprising:

a developer carrier for conveying the developer deposited thereon to said image carrier;

a flexible member facing a surface of said developer carrier and contacting the developer for moving said developer from a position adjoining said developer carrier where said developer is apt to aggregate toward said developer carrier to loosen said developer;

a movable member contacting said flexible member for causing said flexible member to move in an oscillating motion and causing the developer to loosen, said developer charged in frictional contact with the developer carrier and electrostatically deposited and conveyed by the developer carrier, wherein said movable member comprises a shaft extending in a direction substantially perpendicular to a direction in which the surface of said developer carrier moves, and a number of filament-like members implanted in said shaft, said movable member being rotated about said shaft;

movable member driving means for driving said movable member; and developer charging means for depositing a predetermined amount of charge on the developer and located downstream of said flexible member with respect to a direction of rotation of said developer carrier and upstream of a developing position where said developer carrier faces said image carrier.

5. A device as claimed in claim 4, further comprising an abutment member located upstream of a position where said movable member contacts said flexible member with respect to a direction of rotation of said movable member, said filament-like members contacting said abutment in such a manner as to run onto said abutment.

6. A developing device for developing a latent image formed on an image carrier with a developer supplied to said device, comprising:

a developer carrier for conveying the developer deposited thereon to said image carrier;

a flexible member facing a surface of said developer carrier and contacting the developer for moving said developer from a position adjoining said developer carrier where said developer is apt to aggregate toward said developer carrier to loosen said developer, wherein said flexible member is vent along at least a single imaginary line substantially perpendicular to a direction in which the surface of said developer carrier moves, such that said flexible member is convex toward said movable member;

a movable member contacting said flexible member for causing said flexible member to move in an oscillating motion and causing the developer to loosen, said developer charged in frictional contact with the developer carrier and electrostatically deposited and conveyed by the developer carrier;

movable member driving means for driving said movable member; and developer charging means for depositing a predetermined amount of charge on the developer and located downstream of said flexible member with respect to a direction of rotation of said developer carrier and upstream of a developing position where said developer carrier faces said image carrier.

7. A device as claimed in claim 6, further comprising a casing formed with an opening for fitting said flexible member, said opening having a width, in a direction substantially perpendicular to said imaginary line of said flexible member, substantially equal to a width of a portion of said flexible member to be fitted in said opening.

8. A developing device for developing a latent image formed on an image carrier with a developer supplied to said device, comprising:

a developer carrier for conveying the developer deposited thereon to said image carrier;

a flexible member facing a surface of said developer carrier and contacting the developer for moving said developer from a position adjoining said developer carrier where said developer is apt to aggregate toward said developer carrier to loosen said developer;

a movable member contacting said flexible member for causing said flexible member to move in an oscillating motion and causing the developer to loosen, said developer charged in frictional contact with the developer carrier and electrostatically deposited and conveyed by the developer carrier;

movable member driving means for driving said movable member, wherein said movable member driving means and said movable member are located at the outside of said device; and developer charging means for depositing a predetermined amount of charge on the developer and located downstream of said flexible member with respect to a direction of rotation of said developer carrier and upstream of a developing position where said developer carrier faces said image carrier.

* * * * *